US011434711B2

(12) United States Patent
Murphy et al.

(10) Patent No.: US 11,434,711 B2
(45) Date of Patent: Sep. 6, 2022

(54) ANCHOR SLIP ASSEMBLY WITH INDEPENDENTLY DEPLOYABLE WEDGES

(71) Applicant: Halliburton Energy Services, Inc., Houston, TX (US)

(72) Inventors: Robert Travis Murphy, Van Alstyne, TX (US); Terapat Apichartthabrut, Plano, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 75 days.

(21) Appl. No.: 17/171,070

(22) Filed: Feb. 9, 2021

(65) Prior Publication Data

US 2022/0251915 A1 Aug. 11, 2022

(51) Int. Cl.
*E21B 23/06* (2006.01)
*E21B 17/02* (2006.01)

(52) U.S. Cl.
CPC ..... *E21B 23/06* (2013.01); *E21B 17/02* (2013.01)

(58) Field of Classification Search
CPC ..... E21B 23/06; E21B 33/129; E21B 23/01; E21B 33/1208; E21B 33/1293; E21B 23/00; E21B 43/105; E21B 17/02
See application file for complete search history.

(56) References Cited

U.S. PATENT DOCUMENTS

| | | | | |
|---|---|---|---|---|
| 5,566,762 | A | 10/1996 | Braddick et al. | |
| 5,720,343 | A | 2/1998 | Kilgore et al. | |
| 7,779,910 | B2 | 8/2010 | Watson | |
| 3,066,065 | A1 | 11/2011 | Buckner | |
| 10,060,217 | B2 | 8/2018 | Murphree et al. | |
| 10,458,200 | B2 | 10/2019 | Tse | |
| 10,954,736 | B2 * | 3/2021 | Schmidt | E21B 23/01 |
| 2003/0226668 | A1 * | 12/2003 | Zimmerman | E21B 33/1204 166/134 |
| 2012/0298379 | A1 * | 11/2012 | Van Riet | E21B 43/103 166/208 |

(Continued)

FOREIGN PATENT DOCUMENTS

| | | | |
|---|---|---|---|
| EP | 1030031 | 8/2000 | |
| EP | 1172520 A2 * | 1/2002 | E21B 23/01 |
| NO | 20151175 A1 * | 3/2016 | |

(Continued)

OTHER PUBLICATIONS

International Search Report and Written Opinion for Application No. PCT/US2021/018752, dated Nov. 2, 2021.

*Primary Examiner* — Daniel P Stephenson
(74) *Attorney, Agent, or Firm* — Scott Richardson; C. Tumey Law Group PLLC

(57) ABSTRACT

A well tool may include a slip disposed about a mandrel and a plurality of individual wedge sections axially arranged adjacent one another between the mandrel and the slip. In at least one example, a gap is defined between adjacent wedge sections allowing a range of axial movement of one wedge section toward the other. A compliant member is disposed between the adjacent wedge sections resisting movement of the one toward the other. The compliant members may have different sizes and configurations to selectively yield at different axial loads, so that the wedge sections progressively load the slip.

20 Claims, 6 Drawing Sheets

(56) References Cited

U.S. PATENT DOCUMENTS

| | | | | |
|---|---|---|---|---|
| 2014/0209325 | A1* | 7/2014 | Dockweiler | E21B 23/01 166/217 |
| 2017/0370176 | A1* | 12/2017 | Frazier | E21B 33/1212 |

FOREIGN PATENT DOCUMENTS

| | | | | |
|---|---|---|---|---|
| WO | 2014-044630 | | 3/2014 | |
| WO | WO-2015130419 | A1 * | 9/2015 | E21B 33/129 |
| WO | WO-2017151384 | A1 * | 9/2017 | E21B 23/01 |

* cited by examiner

ANCHOR SLIP ASSEMBLY WITH INDEPENDENTLY DEPLOYABLE WEDGES

BACKGROUND

In preparing subterranean wells for production, a sealing system such as a well packer may be run into the well on a work string or a production tubing, optionally with other completion equipment, such as a screen adjacent to a producing formation. The packer may be used to seal the annulus between the outside of the production tubing and the inside of the well casing to block movement of fluids through the annulus past the packer location. The packer may include anchor slips having opposed camming surfaces that cooperate with complementary wedging surfaces, whereby the anchor slips are radially extendible into gripping engagement against the well casing bore in response to relative axial movement of the wedging surfaces. The packer also carries annular seal elements which are expandable radially into sealing engagement against the bore of the well casing in response to axial compression forces. Longitudinal movement of the packer components which set the anchor slips and the sealing elements may be produced hydraulically or mechanically, or the packer may be hydrostatically set.

One challenge to packer design is that the forces involved in setting the packer may deform the casing. With conventional slips, the multi-point loading of the casing wall will deform the casing into a predisposed slip pattern corresponding to the number of individual slips used. Nodes will appear on the casing outer diameter corresponding to each slip segment. This result is not desirable, as it will then become very difficult to land and properly set another packer after the first one is removed. Further, the tubing in such wells is typically made of an expensive, corrosion-resistant alloy, and scratches and indentations can act as stress risers or corrosion points.

To reduce deformation of casing, longer slips are sometimes used to distribute the load more evenly and/or over a larger area of the casing. However, increasing slip length to distribute the load may reduce the force below that required to achieve a reliable slip tooth penetration into the casing. Another approach to reducing casing deformation is to deploy the slip teeth in a pre-defined sequence. Conventionally, this requires the slips and/or wedges to deform for the successive loading surface (hump). The deformation of the slip and/or wedges may have adverse effects during production or retrieval.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are tools and related methods for anchoring a well tool in a tubular member, such as a casing, wherein individual wedge sections may be progressively loaded against a slip without undesirable deformation of the wedge sections. The anchor slip assembly includes multiple wedge sections that are initially formed with an axial gap between adjacent wedge sections. The gaps may initially be maintained by a compliant member between adjacent wedge sections. The compliant member in some embodiments comprise a concealed tab unitarily formed along a channel defined between the adjacent wedge sections, such as using an additive manufacturing process. As the wedge sections are axially loaded, the compliant member will yield or fail prior to full engagement of all the wedge sections, to close the gap between the corresponding adjacent wedge sections. In this manner, the wedge sections are progressively loaded. Desirably, the compliant members allow for progressive loading without deformation of the parent structure of the wedge sections.

In one example, there are at least three wedge sections axially arranged adjacent one another. An axial force may be applied to the first wedge section to axially urge the three wedge sections along a mandrel. The third wedge section is first to radially engage the slip. A tab between the second and third wedge section fails or deforms to bring the second wedge section closer to the third wedge section, so the second wedge section engages the slip. Finally, a tab between the first and second wedge sections fails or deforms, closing a gap therebetween so the first wedge section radially engages the slip. In that way, the wedge sections progressively load the slip from the third wedge section to the second wedge section to the first wedge section, until all three wedge sections have fully engaged the slip into biting engagement with the casing. Of course, the compliant members, gaps between wedge sections, and other design parameters may be adjusted within the scope of this disclosure to achieve deployment of the wedge sections in any desired order or loading sequence.

Figure 1:
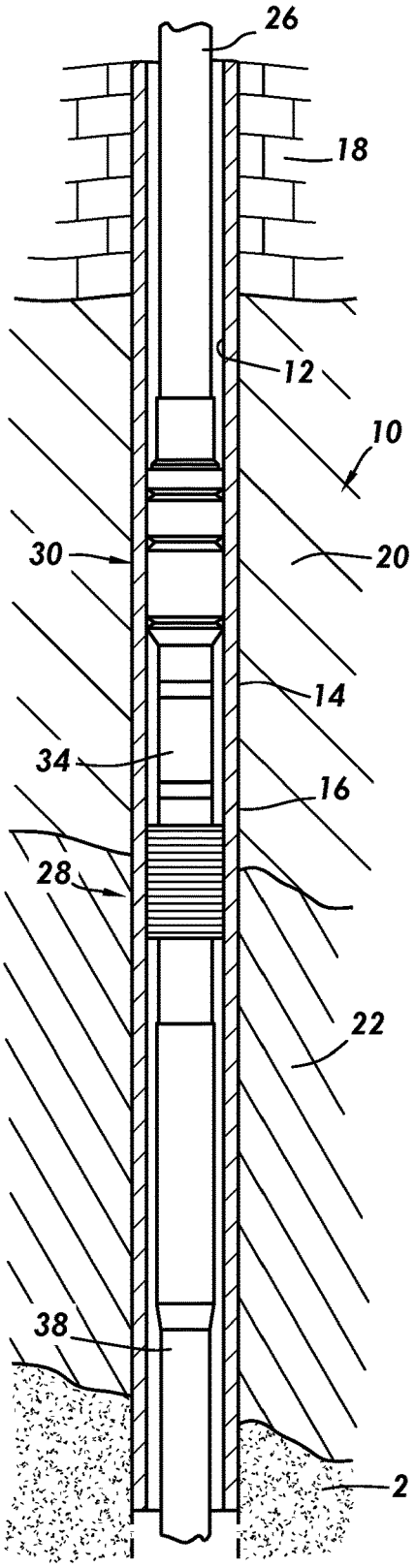
FIG. 1 is an elevation view of a representative well tool deployed downhole and secured within a tubular member by an anchor slip assembly.

FIG. 1 is an elevation view of a representative well tool 10 deployed downhole and secured within a tubular member 14 by an anchor slip assembly 28. It will be understood that any of a variety of well tools may be secured downhole within any suitable tubular member with an anchor slip assembly 28 according to this disclosure. By way of example, the well tool 10 in FIG. 1 is embodied as a well packer 10, and the tubular member in which it is set is a tubular well casing 14. The casing 14 lines a well bore 16, which has been drilled through multiple stratigraphic layers 18, 20 and 22 of the earth, down to and including a hydrocarbon bearing formation 2. The packer 10 may be lowered into the well bore 16 on a tubing string, which may comprise the tubing string 26 shown, and is secured in the desired position within the casing 14 by the anchor slip assembly 28 as further discussed below. The packer 10 is then sealed to the casing 14 with a seal element assembly 30 axially spaced from the anchor slip assembly 28.

The packer 10 includes a mandrel 34 for supporting various components thereon. The mandrel 34 is connected to the tubing string 26, which extends to a wellhead at the ground level (aka "surface") of the well site, for conducting produced fluids from the hydrocarbon bearing formation 2 to the surface. The lower end of the casing 14, which intersects the hydrocarbon bearing formation 2, may be perforated to allow well fluids such as oil and gas to flow from the hydrocarbon bearing formation 2 through the casing 14 into the well bore 12. The packer 10 in this example is releasably set by the anchor slip assembly 28, meaning the packer has the ability for the anchor slip assembly 28 to be subsequently released later to retrieve the packer 10 if needed. The seal element assembly 30 also mounted on the mandrel 34 is expanded against the well casing 14 for providing a fluid tight seal between the mandrel and the well casing, so that formation pressure is held in the well bore below the seal assembly. That way, formation fluids are forced into the bore of the packer 10 to flow to the surface through the production tubing string 26. The anchor slip assembly 28 may be set by axial actuation of certain components on the mandrel, e.g., via hydraulic actuation, as further discussed below. The seal element assembly 30 may be similarly set by axial actuation.

Figure 2:
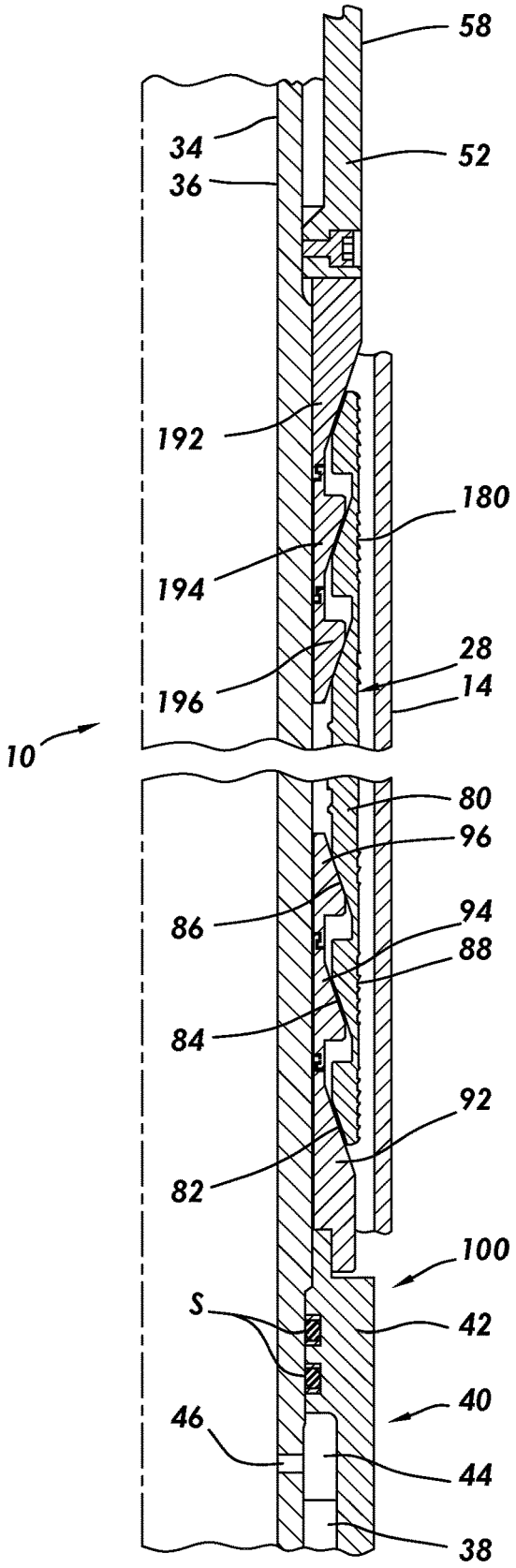
FIG. 2 is an enlarged view of the packer of FIG. 1 focused on an example configuration of the anchor slip assembly.

FIG. 2 is an enlarged view of the packer 10 of FIG. 1 focused on an example configuration of the anchor slip assembly 28. The packer 10 is shown in a run-in position, for running the packer 10 down into the well, prior to hydraulically setting the packer 10 against the casing 14. The anchor slip assembly 28 (and the seal element assembly 30 of FIG. 1) are carried on the mandrel 34, having a cylindrical bore 36 defining a longitudinal production flow passage. The lower end of the mandrel 34 is coupled to a bottom connector sub 38. The bottom connector sub 38 is continued below the packer within the well casing for connecting to a sand screen, polished nipple, tail screen and sump packer, for example. The central passage of the packer bore 36 as well as the polished bore, bottom sub bore, polished nipple, sand screen and the like are concentric with and form a continuation of the tubular bore of the upper tubing string 26 (FIG. 1).

The packer 10 is set by an actuator assembly 40, which is hydraulically operated in this example but could alternatively be controlled by mechanical or electronic actuators, or combinations thereof. Although the present discussion focuses on setting of the anchor slip assembly 28, the same actuator assembly 40 or another actuator may be used to actuate the seal element assembly 30 of FIG. 1. The anchor slip assembly 40 comprises at least one slip, including in this example a first slip 80 disposed about the mandrel 34, and a plurality of interlocking wedge sections 92, 94, 96 axially arranged adjacent one another along the mandrel 34 between the mandrel 34 and the slip 80. The wedge sections 92, 94, 96 are referred to in this configuration as first, second, and third wedge sections, and the terms first, second, and third are not intended to imply any particular arrangement or order of engagement. In this case the three interlocking wedge sections 92, 94, 96 form two pairs {92, 94} and {94, 96} of adjacent wedge sections. The slip 80 includes an outwardly facing casing engagement portion 88 for engagement with the casing 14, and a plurality of inwardly facing ramps 82, 84, 86 in sliding contact with the respective wedge sections 92, 94, 96. As described further below, the wedge sections 92, 94, 96 may be axially shifted by the actuator assembly 40 to urge the slip 80 radially outwardly into biting engagement with the casing 14.

The actuator assembly 40 includes a piston 42 concentrically mounted on the mandrel 34 below the anchor slip assembly 28. The piston 42 is coupled to the lowest or outermost wedge section 92 by an axially-slidable force transmitting sleeve 100. The piston 42 carries annular seals "S" in sealing engagement against the external surface of the mandrel 34 and is also slidably sealed against the external surface of the bottom connector sub 38. The piston 42 encloses an annular chamber 44, which is open to the cylindrical bore 36 at port 46. Hydraulic pressure may be applied through the cylindrical bore 36 to the inlet port 46 to pressurize the annular chamber 44 and urge the piston 42 upward. The force transmitting sleeve 100 is thereby axially shifted by the piston 42 into axial engagement with the first wedge section 92, urging the first wedge section 92 upward. The three wedge sections 92, 94, 96 are coupled so that the force and upward movement of the first wedge section 92 is transferred, in turn, to the second, and third wedge sections 94, 96, to collectively urge the slip 80 radially outwardly into engagement with the casing 14.

An anchor slip assembly according to this disclosure may include any number of slips, wedge sections, and/or sets of wedge sections. By way of example, FIG. 1 optionally includes a second slip 180 and a second set of three wedge sections 192, 194, 196. In a first example configuration, the second slip 180 is an extension of (e.g., unitarily formed or otherwise structurally connected with) the first slip 80 and the sleeve 58 axially secures the second set of wedge sections 192, 194, 196 in place on the mandrel 34. The force transmitting sleeve 100 drives the first set of wedge sections 92, 94, 96 upward, urging the first slip 80 upwardly and radially outwardly, and the second slip 180 is urged upwardly by the first slip 80 and radially outwardly along the static, second set of wedge sections 192, 194, 196. In a second example configuration, the second slip 180 may be structurally separate from the first slip 80, and a second piston (not shown) operating from above may be used to apply a downward force on the second set of wedge sections 192, 194, 196 to urge the upper slip 180 into engagement with the casing 14. In yet another configuration, the two sets of wedge sections 92, 94, 96 and 192, 194, 196 may be coupled by a rigid or compliant member (schematically indicated by dashed linetype) so that the lower piston 42 drives all six wedge sections 92, 94, 96, 192, 194, 196 upward to engage the two slips 80, 180 into engagement with the casing 14. Given similarities in how the wedge sections cooperate to urge the slip(s) into engagement with the casing, the subsequent figures and discussion focus primarily on the first three sets of wedge sections of the anchor slip assembly 28 by way of example.

Figure 3:
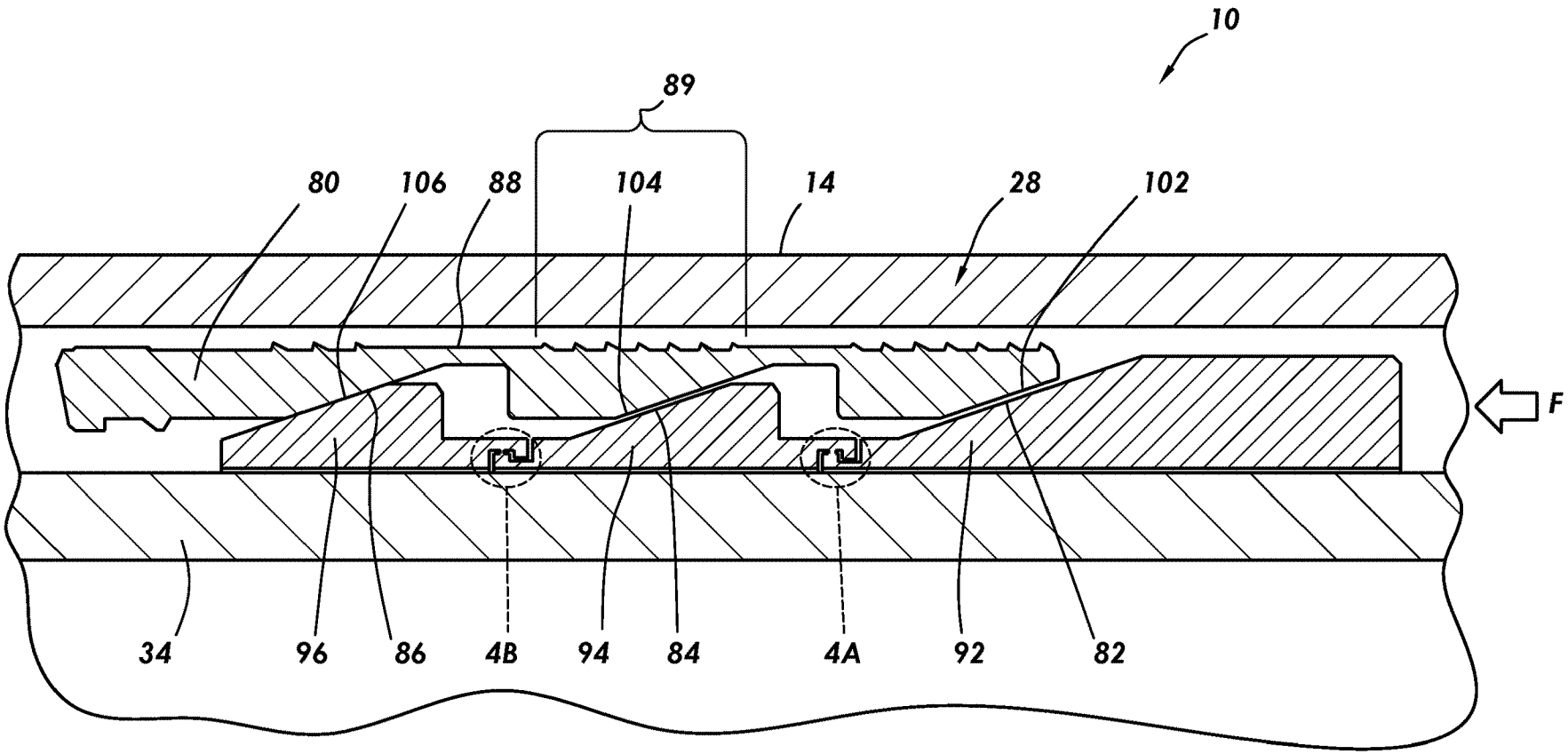
FIG. 3 is an enlarged view of the anchor slip assembly of the well tool prior to engagement with the casing.

FIG. 3 is an enlarged view of the anchor slip assembly 28 of the well tool 10 prior to engagement with the casing 14. The anchor slip assembly 28 includes the mandrel 34, the slip 80 disposed about the mandrel 34 and the plurality of wedge sections 92, 94, 96 axially arranged adjacent one another along the mandrel 34, between the mandrel 34 and the slip 80. The slip 80 includes the plurality of inwardly facing ramps 82, 84, 86, and the outwardly facing casing engagement portion 88. The three wedge sections are arranged end to end, axially along the mandrel 34, so that the first and second wedge sections 92, 94 are adjacent one another and the second and third wedge sections 94, 96 are adjacent one another. Each wedge section 92, 94, 96 includes an outwardly facing ramp 102, 104, 106 for slidably engaging a corresponding one of the inwardly facing ramps 82, 84, 86 on the slip 80.

As an axial force "F" is applied to the first wedge section 92, such as by the force transmitting sleeve 100 of FIG. 2, the outwardly facing ramps 102, 104, 106 slide along the inwardly facing ramps 82, 84, 86 to urge the slip 80 radially outwardly, and optionally slightly axially in the direction of the axial force F, into engagement with the casing 14. The casing engagement portion 88 includes teeth 89, which may be arranged as sets of teeth 89 generally aligned with and opposite the respective inwardly facing ramps 82, 84, 86, for biting engagement with the casing 14. As further detailed in FIGS. 4 and 5, a small gap is defined between adjacent wedge sections, allowing a range of axial movement of one toward the other, and with a compliant member disposed between the adjacent wedge sections resisting movement of the one toward the other. As further detailed in FIG. 7, this arrangement helps to control deployment of the individual wedge sections in a desired sequence and/or degree to progressively load the slip 80, rather than to uniformly load the slip 80 all at once. To better understand this, the next several FIGS. 4A-6 will first discuss some example configurations of the compliant member, a catch, and other features of the anchor slip assembly 28.

Figure 4B:
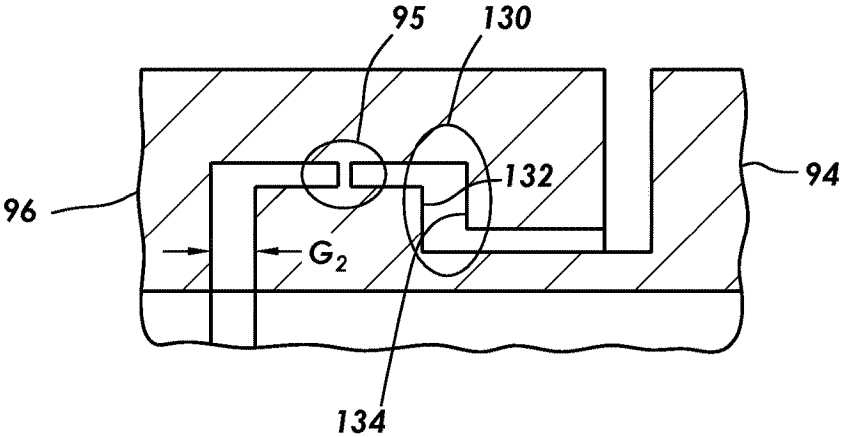
FIG. 4B is an enlarged, detailed view of the interlocking portion between the second and third wedge sections of FIG. 3.
Figure 4A:
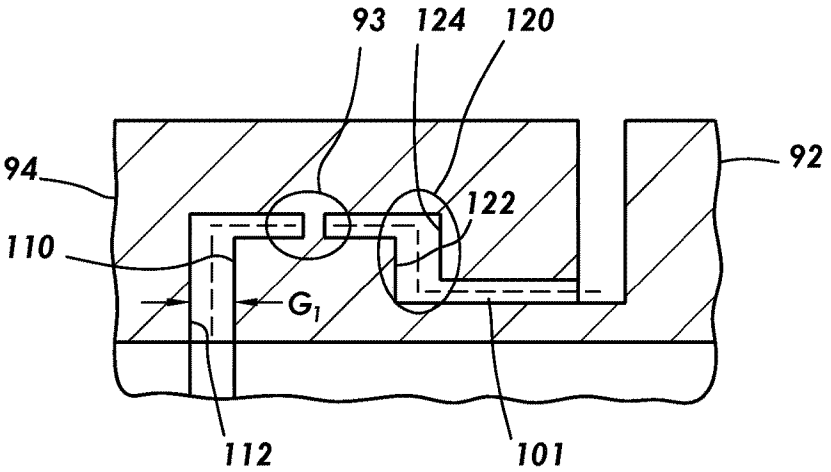
FIG. 4A is an enlarged, detailed view of the interlocking portion between the first and second wedge sections of FIG. 3.

FIG. 4A is an enlarged, detailed view of the interlocking portion between the first and second wedge sections 92, 94 indicated at 4A of FIG. 3. A channel 101 indicated by dashed linetype is defined between the wedge sections 92, 94, which provides some separation between the wedge sections 92, 94 to allow relative movement between the wedge section 92, 94 along the mandrel 34. A gap G1 is initially defined between the first and second wedge sections 92, 94. The gap G1 is defined in this example between a surface 110 of the first wedge section 92 and a surface 112 of the second wedge section 94 that are along the channel 101. The gap G1 is in an axial direction, allowing a range of axial movement of the first wedge section 92 and the second wedge section 94 with respect to one another. The two surfaces 110 in this example are optionally flat, radially extending, and orthogonal to an axis of the mandrel 34, so that when they abut there is no appreciable radial reaction force component, and the wedge section 92 will urge the second wedge section 94 axially along the mandrel 34; however, alternate configurations that achieve this result are also possible. A compliant member 93 is included for initially resisting this movement.

In the FIG. 4A example, the compliant member is a tab 93 initially coupling the adjacent wedge sections 92, 94 along a portion of the channel 101. The tab 93 is also concealed between the adjacent wedge sections and is unitarily formed with the adjacent wedge sections. This structure, including the wedge sections 92, 94, concealed tab 93, and the channel 101, may be unitarily formed by additive manufacturing, such as by radially layering successively-formed axially-extending layers. The tab 93 is configured to yield without yielding of the adjacent wedge sections 92, 94 in response to the movement of the one toward the other to close the gap G1. More specifically, in this example, the tab 93 is configured to break in response to moving the adjacent wedge sections toward one another to close the gap G1. This "frangible tab" configuration may be achieved, for instance, by sizing and shaping the tab 93 so that it plastically deforms to the point of failure in response to moving the first wedge section 92 until the surface 110 abuts the surface 112 of the second wedge section 94. Alternatively, the tab 93 could be configured to elastically deform, like a spring element, without necessarily failing, and still provide a desired resistance to the movement. The tab may include a stress concentration to facilitate yielding, and in some cases, to preferentially yield before another tab between another two adjacent wedge sections. Once the frangible tab fails, the overlapping or interlocking structure of the wedge sections allows ample relative radial clearance therebetween (e.g., along the channel 101) to help accommodate any incidental radial movement between the wedge sections in response to the progressive loading thereof The adjacent wedge sections 92, 94 are also interlocking in the sense that, even disregarding the tab 93, the structure of the adjacent wedge sections 92, 94 and how they are coupled limit a range of axial movement between the two wedge sections 92, 94, including limiting how far they may be axially separated. More particularly, this interlocking configuration comprises a catch 120 that includes cooperating catch members 122, 124 on adjacent wedge sections 92, 94. When coupled as shown, the catch members 122, 124 cooperate (e.g., by interference therebetween) to limit a range of axial separation between the adjacent wedge sections 92, 94. The packer or other tool may be retrievable, in which case moving the first wedge section 92 axially away from the second wedge section 94 (opposite the direction of force F in FIG. 3) will allow the first wedge section 92 to initially move independently of the second wedge section, until the catch member 122 engages the other catch member 124. When the catch member 122 engages the other catch member 124, further movement of the wedge section 92 will pull the second wedge section 94 along with it, and so on.

FIG. 4B is an enlarged, detailed view of the interlocking portion between the second and third wedge sections 94, 96 indicated at 4A of FIG. 3. The structure of FIG. 4B is similar to that of FIG. 4A, except that a gap G2 initially defined between the first and second wedge sections 94, 96 may be the same or different size than the gap G1 defined between the first wedge section 92 and second wedge section 94. A second tab 95 initially coupling the adjacent wedge sections 94, 96, similarly to the tab 93, has a different stiffness (thinner and less stiff in this example) so that the second tab 95 will preferentially yield or break before the first tab 93. This may be achieved, for instance, by making the second tab 95 thinner than the first tab 93, as shown, or with a stress concentration to preferentially yield or fail the second tab 95 before the first tab 93. A catch 130 including catch members 132, 134 is structurally similar to the catch 120 of FIG. 4A.

Figure 6:
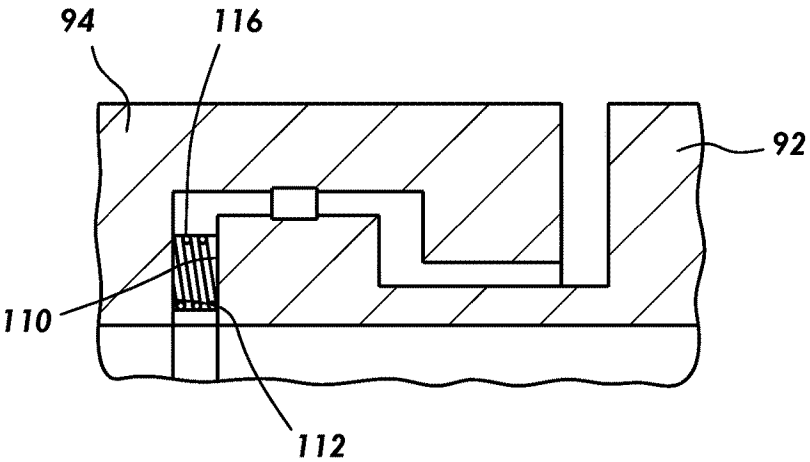
FIG. 6 is another modified version of the interlocking portion between the first and second wedge sections, wherein the compliant member comprises a spring.
Figure 5:
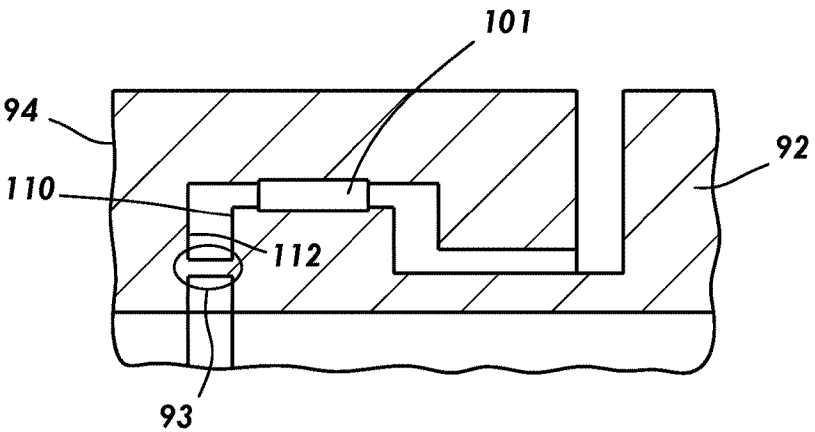
FIG. 5 is a modified version of the interlocking portion between the first and second wedge sections, wherein the tab is moved to a different location along the channel.

The compliant member may take any of a variety of configurations and is not limited to being a tab or the particular location of FIG. 4A. Two alternative examples of compliant members are shown in FIGS. 5 and 6. Any other compliant members that limit axial movement between wedge sections are considered within the scope of this disclosure. The compliant members may even be omitted in configurations where selective engagement of the wedge sections may be controlled solely by initial axial spacing between adjacent wedge sections.

FIG. 5 is a modified version of the interlocking portion 4A between the first and second wedge sections 92, 94, wherein the tab 93 is moved to a different location along the channel 101. Specifically, the tab 93 is between the two opposing surfaces 110, 112 that define the gap G1 between the first and second wedge sections 92, 94. The tab 93 in this alternate location still serves as a compliant member, which preferentially yields without yielding of the much thicker and stiffer structures of the wedge sections 92, 94 that it couples. The tab 93 at this location may compress, buckle, or otherwise deform or fail as the first wedge section 92 is forcibly urged axially toward the second section 94.

FIG. 6 is another modified version of the interlocking portion between the first and second wedge sections 92, 94, wherein the compliant member comprises a spring 116. The spring 116 is disposed between the two opposing surfaces 110, 112 that define the gap G1 between the first and second wedge sections 92, 94. The tab is omitted. The spring 116 may take any structural form that elastically resists movement of the first wedge section 92 toward the second wedge section 94. A compression washer, coil spring, or elastomeric element are just some examples of possible spring types. The spring 116 yields such as by flexing, compressing, or otherwise elastically deforming without yielding of the much thicker and stiffer structures of the wedge sections 92, 94 that it abuts. The two wedge sections 92, 94 may be assembled with the spring 116 disposed between them, such as if at least one of the two catch members 122, 124 is flexible to allow them to be connected, like a collet (See, e.g., FIGS. 10-13 below).

Figure 7:
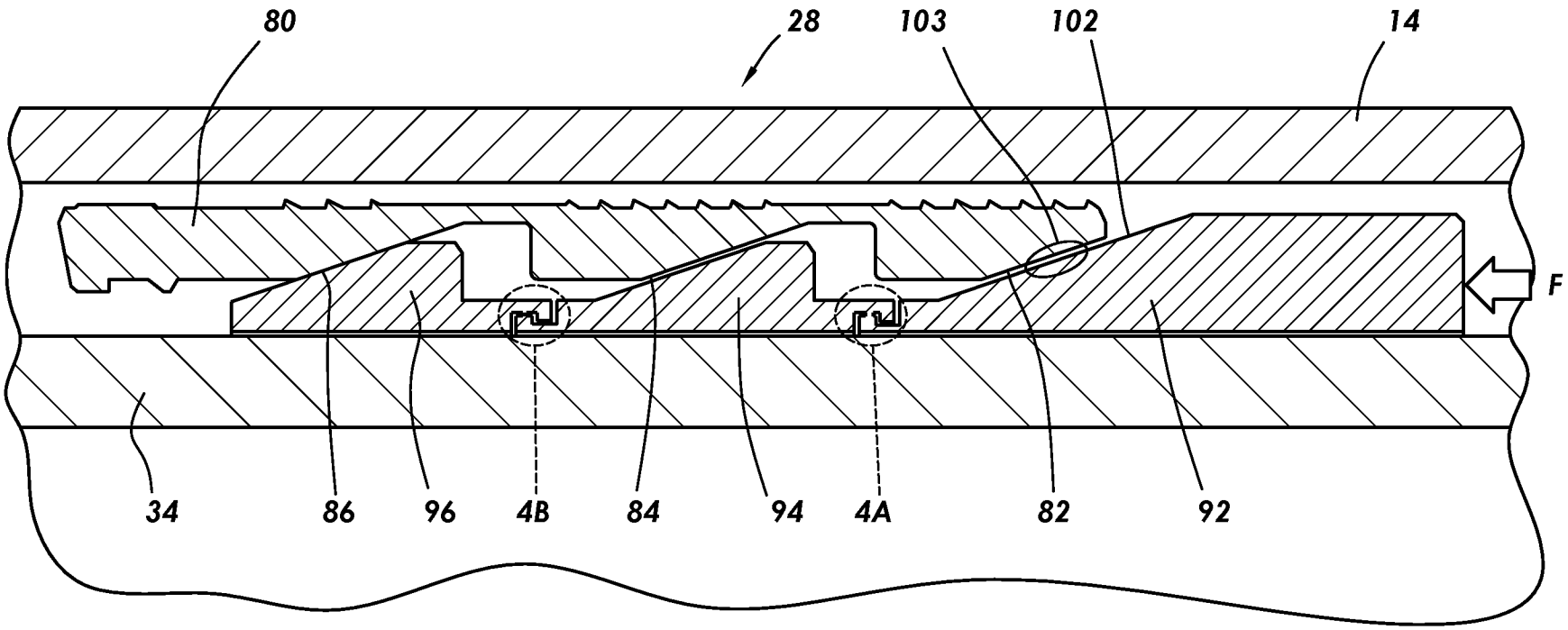
FIG. 7 is another enlarged view of the anchor slip assembly of the well tool for explaining an example sequence of deployment of the wedge sections into engagement with the casing.

FIG. 7 is another enlarged view of the anchor slip assembly 28 of the well tool 10 for explaining an example sequence of deployment of the wedge sections 92, 94, 96 into engagement with the casing 14. Generally, features of the interlocking portions 4A and 4B, such as the gaps and compliant members, may be selectively configured to control when, to what extent, and/or in what order each wedge section 92, 94, 96 deploys. The following is just an example sequence of deployment based on the example structure shown.

When the axial force F is initiated, the tabs at each interlocking portion 4A and 4B (discussed above) are still intact. Therefore, as the axial force "F" is applied to the first wedge section 92, all three wedge sections 92, 94, 96 will initially move together to the left along the mandrel 34. The third (left) wedge section 96 is initially just contacting the inwardly facing ramp 86 of the slip 80, while there is still a slight separation at 103 between the inwardly facing ramp 82 and outwardly facing ramp 102 of the first (right) wedge section 92. Therefore, the third wedge section 96 will be first to engage the slip 80 and start urging it radially outwardly toward engagement with the casing 14.

The compliant tab at interlocking portion 4B (on the left), being thinner and less stiff than the tab at interlocking portion 4A (on the right), will yield or fail before the tab at interlocking portion 4A in response to force F. Failure of that tab will cause the gap (G2) between the second and third wedge sections 94, 96 to close. As the first and second wedge sections 92, 94 then move together to the left, the second (middle) wedge section 94 engages and increases its engagement with the slip 80 at the corresponding inwardly facing ramp 84. As the force F increases and continues to be applied, the tab in the other interlocking portion 4B will eventually fail, causing the gap (G1) between the first and second wedge sections 92, 94 to close. The first (right) wedge section 96 will be last of those three wedge sections to engage the slip.

The geometry of the anchor slip assembly 28 may be designed to achieve the desired sequence and timing of deployment of the wedge sections. In the above example, the third (left) wedge section 96 is the first to engage the slip, followed by the second (middle) wedge section 94 and then the first (right) wedge section 96. The geometry such as the spacing between wedge sections and the configurations of the tab or other compliant members can be selected at the design stage to adjust or fine-tune how gradually each wedge section will deploy. The deployment of the wedge sections may also be overlapping in terms of the onset and rate of deployment. For example, although the third (left) wedge section 96 may be first to engage, the second (middle) wedge section 94 may start to engage the slip 80 before the third wedge section has reached full deployment (maximum radial force on the slip). Likewise, the first wedge section 96 may start to engage the slip 80 before the second or third wedge section have reached full deployment. The effect is still to initiate load from one side (the left side in FIG. 7) and gradually increase the load toward the other (right) side. Despite the sequential increase in loading, upon full engagement, the radial load seen by all three wedge sections 92, 94, 96 may be substantially equal.

It should be recognized that another sequence could be achieved, if desired. For example, the order of the deployment could even be reversed, if desired, by making the tab in 4B stouter than the tab in 4A, and/or by adjusting the length of the wedge sections so that the first wedge section 92 contacts the slip before the second and third wedge sections 94, 96. The stiffness and locations of the tabs or other compliant members, as well as the gaps between adjacent wedge sections, may also be adjusted in the design of the anchor slip assembly 28 to control the differential of engagement, such as the timing and how rapidly the radial load on one wedge section increases with respect to the other wedge section(s).

As can be understood in view of the above description, a feature of this disclosure in its various embodiments is that relative movement between wedge sections may be allowed, optionally with deformation of a sacrificial member such as a tab, but without deforming the wedge sections themselves. This is preferable to a rigid, unitary structure of wedge sections, which would require deformation and possible damage to that structure to achieve progressive loading. The tab or other compliant member preferentially deforms, rather than the parent structure of the wedge sections.

Figure 8:
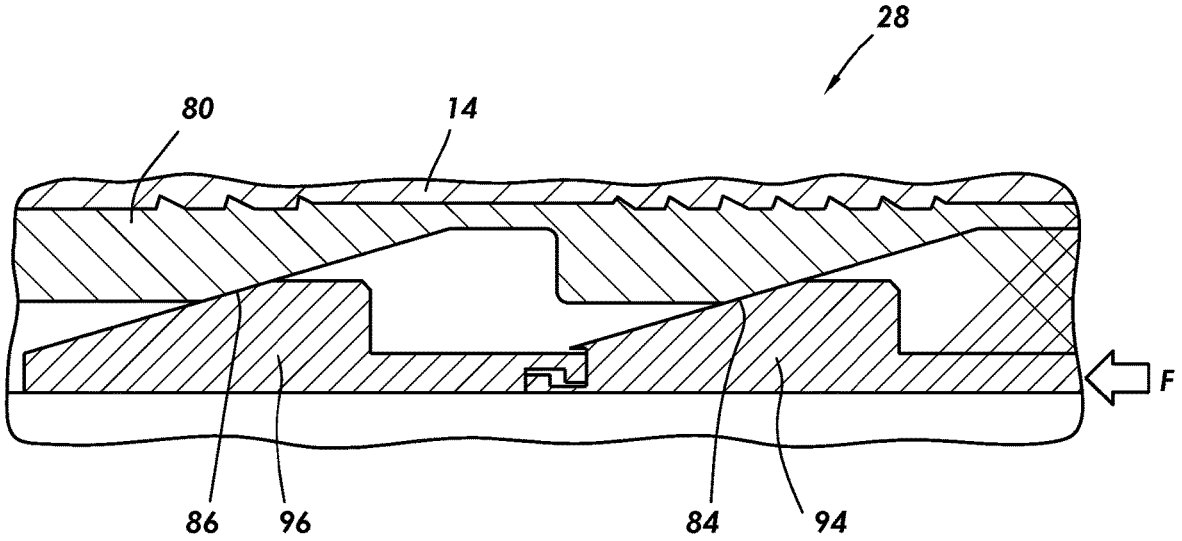
FIG. 8 is a sectional view of the second and third wedge sections during setting of the anchor slip assembly.
Figure 9:
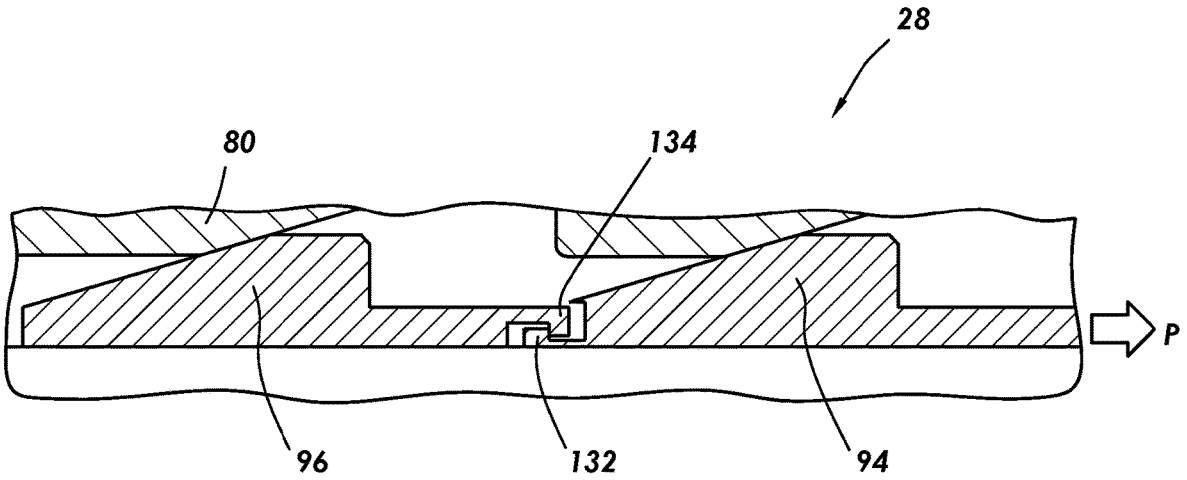
FIG. 9 is a sectional view of the second and third wedge sections when disengaging from the slip as a step in the retrieval of the of the anchor slip assembly.

In addition to a sequential or progressive engagement of the wedge sections, the anchor slip assembly 28 the interlocking aspect of the wedge sections also allows for the sequential disengagement of the wedge sections. The progressive disengagement is particularly useful in a retrievable tool design. FIGS. 8 and 9 further illustrate how the interlocking structure of the wedge sections may be used to both successively engage the wedge sections during deployment and successively disengage the wedge sections during retrieval of a tool.

FIG. 8 is a sectional view of the second and third wedge sections 94, 96 during setting of the anchor slip assembly 28. The second wedge section 94 has been urged into engagement with the third wedge section 96, yielding or breaking any tab or other compliant member therebetween, and closing the gap G2 of FIG. 4B. The force F applied to the first wedge section 92 (FIG. 7) will be applied through the wedge sections and thus move the two wedge sections 94, 96 together as they slide along the inwardly facing ramp sections of the slip 80 into radial engagement with the casing 14.

FIG. 9 is a sectional view of the second and third wedge sections 94, 96 when disengaging from the slip 80 as a step in the retrieval of the of the anchor slip assembly 28. An axial pulling force "P" is applied through the interlocking wedge sections to the wedge sections 94, 96, opposite the force F used to set the slip 80. The second wedge section 94 has been urged the opposite direction of FIG. 8, moving its catch member 132 into engagement with the other catch member 134. The force P will thus urge both wedge sections 94, 96 together as they slide in the opposite direction of FIG. 8 along the inwardly facing ramp sections of the slip 80 into radial engagement with the casing 14. The range of axial movement between the second and third wedge sections 94, 96, and the range of movement between the first and second wedge sections 92, 96, may thus allow the sequential disengagement of the wedge sections from the slip 80. The sequential disengagement of wedge sections requires less pulling force than all wedge sections together at the same time.

Figure 10:
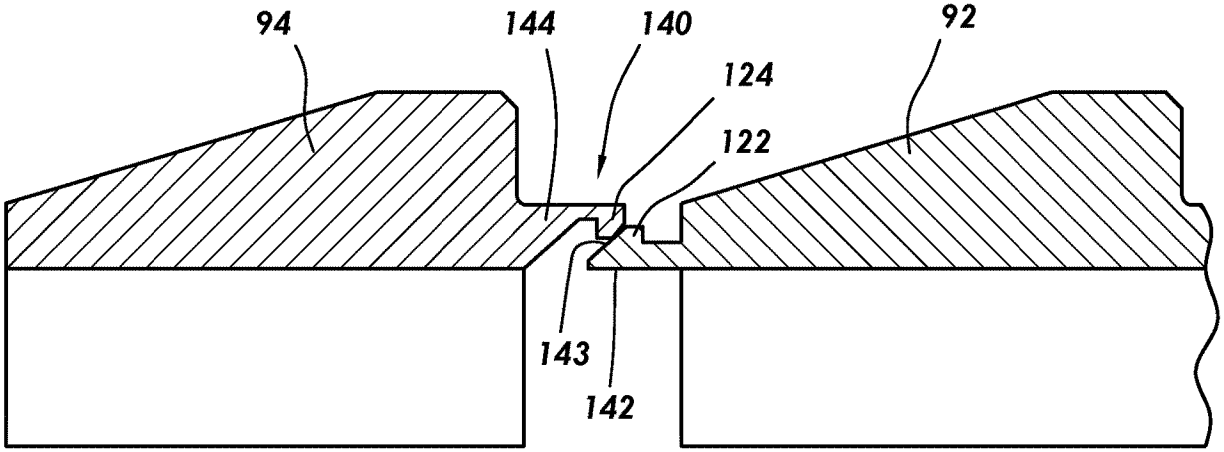
FIG. 10 is a sectional view of an alternative configuration with an optional "collet" type connector between two wedge sections.

FIG. 10 is a sectional view of an alternative configuration with an optional "collet" type connector 140 between two wedge sections 92, 94. The connector 140 in this example may function both as the compliant member, to resist axial movement between the wedge sections when setting the well tool, and as a catch, when unsetting the tool. The connector 140 includes a first connector member 142 extending from the first wedge section 92 and a second connector member 144 extending from the second wedge section 94. At least one connector member, in this case connector member 142, has a barbed end 143, and at least one of the connector members 142, 144 may be flexible. The catch members 122, 124 are defined by the respective connector members 142, 144 in this configuration. The connector members 142, 144 may cooperate to connect the wedge sections 92, 94 upon setting of the slip and then remain connected via the catch members 122, 124 during disengagement, as illustrated in FIGS. 11-13.

Figure 11:
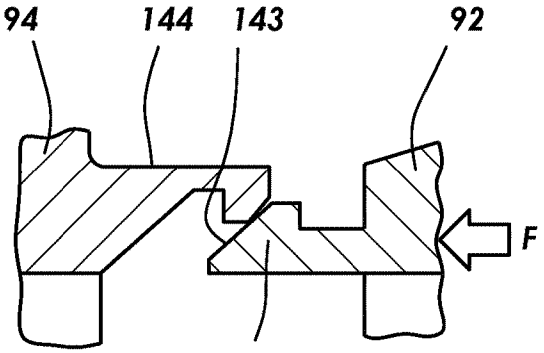
FIG. 11 shows the connector members upon initial contact as the setting force F is applied through the first wedge section toward the second wedge section.

FIG. 11 shows the connector members 142, 144 upon initial contact as the setting force F is applied through the first wedge section 92 toward the second wedge section 94. The barbed end 143 of the connector member 142 has just contacted the end of the other connector member 144. Under the applied force F, the connector member 144 will slide along the barbed end 143, causing one or both connector members 142, 144 to flex.

Figure 12:
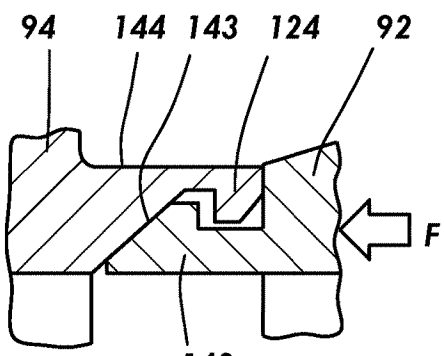
FIG. 12 shows the connector members during setting, after the barbed end on the connector member has slid past the catch of the other connector member and snapped back into place.

FIG. 12 shows the connector members 142, 144 during setting, after the barbed end 143 on the connector member 142 has slid past the catch member 124 of the other connector member 144 and snapped back into place. The end of the connector member 144 is now abutting the first wedge section 92, so that further movement of the first wedge section 92 under the force F will urge the second wedge section 94 in the same direction.

Figure 13:
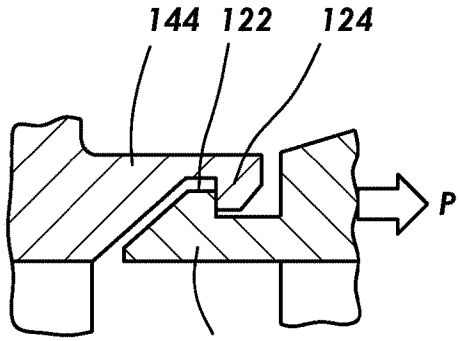
FIG. 13 shows the first wedge section urged in the opposite direction under the axial pulling force P to unset the tool.

FIG. 13 shows the first wedge section 92 urged in the opposite direction under the axial pulling force P to unset the tool. In moving from the position of FIG. 12 to the position of FIG. 13, the first wedge section 92 moves independently of the second wedge section 94 until the catch member 122 included on the connector member 142 engages the cooperating catch member 124 on the other connector member 144 as shown. Thus, the two catch members cooperate to limit a range of axial separation between the adjacent wedge sections. With the two catch members 122, 124 engaged, further movement of the wedge section 92 under the applied force P will pull the second wedge section 94 along with it.

Related methods are also within the scope of this disclosure, wherein the deployment of individual wedge sections is controlled, in part, by the selection of compliant members disposed between adjacent wedge sections. The wedge sections may be deployed and loaded in any desired order or progression based on the parameters set forth herein. Broadly, one example method of setting a well tool involves disposing the well tool, such as a packer, downhole in a tubing segment, such as a casing cemented in a wellbore. A plurality of wedge sections are arranged between a mandrel and a slip. An axial force is applied to a first wedge section in a direction toward a second wedge section to progressively move the first wedge section and the second wedge section into radial engagement with the slip. A first compliant member disposed between the first and second wedge sections is yielded or failed at some point during the loading to move the first wedge section closer to the second wedge sections, which varies the subsequent relative radial engagement of the first wedge section with respect to the radial engagement of the second wedge section.

Any number of wedge sections may be employed. For example, this example method may further include applying the axial force to the first wedge section to progressively move the first wedge section, the second wedge section adjacent to the first wedge section, and also a third wedge section adjacent to the second wedge section into radial engagement with the slip. The method may also involve yielding a second compliant member disposed between the second and third wedge sections to move the second wedge section toward the third wedge section, to vary the radial engagement of the third wedge section with respect to the radial engagement of the first or second wedge section.

Accordingly, the present disclosure may provide an anchor slip assembly for a well tool, such as a packer, wherein individual wedge sections may be progressively deployed in any given order or sequence, to progressively load a slip. The tool may be retrievable, in which case the anchor slip assembly may allow for progressively unsetting of the wedge sections via relative axial movement between the wedge sections. Related methods for using the anchor assembly are also within the scope of this disclosure, as are systems and tools employing such an anchor slip assembly. The methods/systems/compositions/tools may include any of the various features disclosed herein, including one or more of the following statements.

Statement 1. A well tool, comprising: a mandrel; a slip disposed about the mandrel and including a plurality of inwardly facing ramps and an outwardly facing tubing engagement portion; a plurality of wedge sections axially arranged along the mandrel to form at least one pair of adjacent wedge sections, each wedge section including an outwardly facing ramp for slidably engaging a corresponding one of the inwardly facing ramps on the slip; a gap defined between adjacent wedge sections allowing a range of axial movement of one toward the other; and a compliant member disposed between the adjacent wedge sections resisting movement of the one toward the other.

Statement 2. The well tool of Statement 1, wherein the compliant member includes a tab initially coupling the adjacent wedge sections, the tab configured to yield without yielding of the adjacent wedge sections in response to the movement of the one toward the other to close the gap.

Statement 3. The well tool of Statement 2, wherein the tab is configured to fail in response to movement of the adjacent wedge sections toward one another to close the gap.

Statement 4. The well tool of Statements 2 or 3, wherein the tab is concealed between the adjacent wedge sections and is unitarily formed with the adjacent wedge sections as a product of an additive manufacturing process.

Statement 5. The well tool of any of Statements 2-4, wherein the tab is configured with a stress concentration to preferentially yield before the adjacent wedge sections or another tab.

Statement 6. The well tool of any of Statements 1-5, further comprising: the plurality of wedge sections include at least a first wedge section, a second wedge section adjacent the first wedge section, and a third wedge section adjacent the second wedge section.

Statement 7. The well tool of Statement 6, wherein the compliant member between adjacent wedge sections includes a first compliant member between the first and second wedge sections and a second compliant member between the second and third wedge sections, wherein the first compliant member is stiffer than the second compliant member.

Statement 8. The well tool of Statement 7, wherein each compliant member includes a tab, and the tab between the first and second wedge sections is stiffer than the tab between the second and third wedge sections.

Statement 9. The well tool of Statement 6 or 7, wherein the gap between the first and second wedge sections is greater than the gap between the second and third wedge sections.

Statement 10. The well tool of any of Statements 1-7, further comprising: a catch including cooperating catch members on adjacent wedge sections that, when engaged, cooperate to limit a range of axial separation between the adjacent wedge sections.

Statement 11. The well tool of Statement 10, further comprising: a connector including a first connector member on a first wedge section of a pair and a second connector member on a second wedge section of that pair, wherein the first and second connector members include cooperating catch members, and wherein one of the first and second connector members is flexible to connect the connector members upon axial engagement of the first wedge section with the second wedge section.

Statement 12. The well tool of any of Statements 1-6, further comprising: the plurality of wedge sections including at least a first wedge section, a second wedge section adjacent the first wedge section, and a third wedge section adjacent the second wedge section; and a range of axial separation between the first and second wedge sections is greater than a range of axial separation between the second and third wedge sections.

Statement 13. The well tool of any of Statements 1-12, wherein the tubing engagement portion of the slip is a casing engagement portion having a plurality of teeth for engagement with a casing.

Statement 14. A method of setting a well tool, comprising: disposing the well tool downhole; of a plurality of wedge sections arranged along a mandrel, applying an axial force to a first wedge section in a direction toward a second wedge section to progressively move the first wedge section and the second wedge section into radial engagement with a slip; and yielding a first compliant member disposed between the first and second wedge sections to move the first wedge section toward the second wedge sections to vary the radial engagement of the first wedge section with respect to the radial engagement of the second wedge section.

Statement 15. The method of Statement 14, further comprising: radially engaging the second wedge section with the slip before radially engaging the first wedge section with the slip; and wherein yielding the first compliant member includes increasing the axial force on the first wedge section after radially engaging the second wedge section with the slip.

Statement 16. The method of Statement 13 or 14, wherein yielding the first compliant member includes failing the compliant member in response to the axial force applied to the first wedge section.

Statement 17. The method of any of Statement 14-16, further comprising: applying the axial force to the first wedge section to progressively move the first wedge section, the second wedge section adjacent to the first wedge section, and a third wedge section adjacent to the second wedge section into radial engagement with the slip.

Statement 18. The method of Statement 17, further comprising: yielding a second compliant member disposed between the second and third wedge sections to move the second wedge section toward the third wedge section, to vary the radial engagement of the third wedge section with respect to the radial engagement of the first or second wedge section.

Statement 19. The method of Statement 18, further comprising: radially engaging the third wedge section with the slip before radially engaging the first wedge section with the slip; and yielding the second compliant member before yielding the first compliant member, to close a gap between the second wedge section and the third wedge section before closing a gap between the first wedge section and the second wedge section.

Statement 20. A well tool, comprising: a mandrel; a slip disposed about the mandrel and comprising a plurality of inwardly facing ramps and an outwardly facing casing engagement portion; at least first, second, and third wedge sections axially arranged along the mandrel between the mandrel and the slip, with the first wedge section adjacent the second wedge section and the second wedge section adjacent the third wedge section, each wedge section including an outwardly facing ramp for slidably engaging a corresponding one of the inwardly facing ramps on the slip, and with a gap initially defined between the first and second wedge sections and a gap initially defined between the second and third wedge sections; a first compliant member disposed between the first and second wedge sections resisting movement of the one toward the other and a second compliant member disposed between the second and third wedge sections resisting movement of one toward the other; and wherein one or both of second and third wedge sections radially engage the slip prior to the first wedge section.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A well tool, comprising:

a mandrel;

a slip disposed about the mandrel and including a plurality of inwardly facing ramps and an outwardly facing tubing engagement portion;

a plurality of wedge sections axially arranged along the mandrel to form at least one pair of adjacent wedge sections, each wedge section including an outwardly facing ramp for slidably engaging a corresponding one of the inwardly facing ramps on the slip;

a gap defined between adjacent wedge sections allowing a range of axial movement of one toward the other; and a compliant member disposed between the adjacent wedge sections resisting movement of the one toward the other.

2. The well tool of claim 1, wherein the compliant member includes a tab initially coupling the adjacent wedge sections, the tab configured to yield without yielding of the adjacent wedge sections in response to the movement of the one toward the other to close the gap.

3. The well tool of claim 2, wherein the tab is configured to fail in response to movement of the adjacent wedge sections toward one another to close the gap.

4. The well tool of claim 2, wherein the tab is concealed between the adjacent wedge sections and is unitarily formed with the adjacent wedge sections as a product of an additive manufacturing process.

5. The well tool of claim 2, wherein the tab is configured with a stress concentration to preferentially yield before the adjacent wedge sections or another tab.

6. The well tool of claim 1, further comprising:

the plurality of wedge sections include a first wedge section, a second wedge section adjacent the first wedge section, and a third wedge section adjacent the second wedge section.

7. The well tool of claim 6, wherein the compliant member between adjacent wedge sections includes a first compliant member between the first and second wedge sections and a second compliant member between the second and third wedge sections, wherein the first compliant member is stiffer than the second compliant member.

8. The well tool of claim 7, wherein the first and second compliant members each include a tab, and the tab between the first and second wedge sections is stiffer than the tab between the second and third wedge sections.

9. The well tool of claim 6, wherein the gap between the first and second wedge sections is greater than the gap between the second and third wedge sections.

10. The well tool of claim 6, wherein a range of axial separation between the first and second wedge sections is greater than a range of axial separation between the second and third wedge sections.

11. The well tool of claim 1, further comprising:

a catch including cooperating catch members on adjacent wedge sections that, when engaged, cooperate to limit a range of axial separation between the adjacent wedge sections.

12. The well tool of claim 11, further comprising:

a connector including a first connector member on a first wedge section of a pair and a second connector member on a second wedge section of that pair, wherein the first and second connector members include cooperating catch members, and wherein one of the first and second connector members is flexible to connect the connector members upon axial engagement of the first wedge section with the second wedge section.

13. The well tool of claim 1, wherein the tubing engagement portion of the slip is a casing engagement portion having a plurality of teeth for engagement with a casing.

14. A method of setting a well tool, comprising:

disposing the well tool downhole;

of a plurality of wedge sections arranged along a mandrel, applying an axial force to a first wedge section in a direction toward a second wedge section to progressively move the first wedge section and the second wedge section into radial engagement with a slip; and yielding a first compliant member disposed between the first and second wedge sections to move the first wedge section toward the second wedge sections to vary the radial engagement of the first wedge section with respect to the radial engagement of the second wedge section.

15. The method of claim 14, further comprising:

radially engaging the second wedge section with the slip before radially engaging the first wedge section with the slip; and wherein yielding the first compliant member includes increasing the axial force on the first wedge section after radially engaging the second wedge section with the slip.

16. The method of claim 14, wherein yielding the first compliant member includes failing the compliant member in response to the axial force applied to the first wedge section.

17. The method of claim 14, further comprising:

applying the axial force to the first wedge section to progressively move the first wedge section, the second wedge section adjacent to the first wedge section, and a third wedge section adjacent to the second wedge section into radial engagement with the slip.

18. The method of claim 17, further comprising:

yielding a second compliant member disposed between the second and third wedge sections to move the second wedge section toward the third wedge section, to vary the radial engagement of the third wedge section with respect to the radial engagement of the first or second wedge section.

19. The method of claim 18, further comprising:

radially engaging the third wedge section with the slip before radially engaging the first wedge section with the slip; and yielding the second compliant member before yielding the first compliant member, to close a gap between the second wedge section and the third wedge section before closing a gap between the first wedge section and the second wedge section.

20. A well tool, comprising:

a mandrel;

a slip disposed about the mandrel and including a plurality of inwardly facing ramps and an outwardly facing casing engagement portion;

at least first, second, and third wedge sections axially arranged along the mandrel between the mandrel and the slip, with the first wedge section adjacent the second wedge section and the second wedge section adjacent the third wedge section, each wedge section including an outwardly facing ramp for slidably engaging a corresponding one of the inwardly facing ramps on the slip, and with a gap initially defined between the first and second wedge sections and a gap initially defined between the second and third wedge sections;

a first compliant member disposed between the first and second wedge sections resisting movement of the one toward the other and a second compliant member disposed between the second and third wedge sections resisting movement of one toward the other; and wherein one or both of second and third wedge sections radially engage the slip prior to the first wedge section.

* * * * *